US006858273B2

(12) United States Patent
Kawano et al.

(10) Patent No.: US 6,858,273 B2
(45) Date of Patent: Feb. 22, 2005

(54) POROUS ABSORBENT AND INK JET RECORDING APPARATUS

(75) Inventors: Takenobu Kawano, Tokyo (JP); Hirohide Matsuhisa, Kanagawa (JP); Jun Katayanagi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 228 days.

(21) Appl. No.: 10/207,138

(22) Filed: Jul. 30, 2002

(65) Prior Publication Data

US 2003/0030693 A1 Feb. 13, 2003

(30) Foreign Application Priority Data

Aug. 1, 2001 (JP) ..... 2001-233927
May 23, 2002 (JP) ..... 2002-149701

(51) Int. Cl.[7] ..... B41M 5/40
(52) U.S. Cl. ..... 428/32.24; 442/312; 347/36
(58) Field of Search ..... 428/32.24; 442/312; 347/36

(56) References Cited

U.S. PATENT DOCUMENTS 5,505,264 A 4/1996 Morris et al. ..... 168/12
5,679,218 A 10/1997 Vinson et al. ..... 162/109
5,785,817 A 7/1998 Tan et al. ..... 162/218
6,267,465 B1 7/2001 Sawicki ..... 347/36
6,409,883 B1 * 6/2002 Makolin et al. ..... 162/52
6,432,272 B1 * 8/2002 Hollenberg et al. ..... 162/204

FOREIGN PATENT DOCUMENTS

| | | |
|---|---|---|
| JP | 9-78500 | 3/1997 |
| JP | 10-28702 | 2/1998 |
| JP | 2000-119999 | 4/2000 |
| JP | 2000-120000 | 4/2000 |
| JP | 2000-135797 | 5/2000 |
| WO | WO 00/36217 | 6/2000 |
| WO | WO 00/62730 | 10/2000 |

* cited by examiner

*Primary Examiner*—B. Shewareged
(74) *Attorney, Agent, or Firm*—Fitzpatrick, Cella, Harper & Scinto

(57) ABSTRACT

A porous absorbent can be formed using recycling materials, which makes it possible to provide at lower costs an excellent capability of absorbing ink or the like, as well as an excellent handling performance. The porous absorbent contains at least virgin fiber, old paper fiber of waste newspaper, and hemp fiber, and an ink jet recording apparatus is provided with such porous absorbent for absorbing waste ink discharged from the recording head thereof.

36 Claims, 3 Drawing Sheets

POROUS ABSORBENT AND INK JET RECORDING APPARATUS

BACKGROUND OF THE INVENTION

1. Field of the Invention

The present invention relates to a porous absorbent capable of absorbing ink or the like, and also, relates to an ink jet recording apparatus provided with such porous absorbent. As a specific example, the present invention is applicable to an ink absorbent used for absorbing waste ink exhausted from an ink jet recording apparatus, and to the ink jet recording apparatus, which is provided with such waste ink absorbent.

2. Related Background Art

The ink jet recording method is widely utilized for a printer or a copying machine, because the method makes it easier to downsize the apparatus, which can operate with a lesser amount of noise at a lower running cost, and also, makes it easier to provide color prints. When using the ink jet recording apparatus, however, there may be encountered defective discharge (including disabled one) if ink discharge port is clogged by the adhesion of foreign substance, such as paper fluff or dust particles, to the ink discharging portion of a recording head or if ink adhering to the discharging portion is dried to make it overly viscous or solidified. Also, when a new ink cartridge or a head cartridge is used, the ink flow path from the ink discharge port to the ink tank is not necessarily in the normal condition. Therefore, in order to prevent the ink discharge port from being clogged or to normalize the ink flow path, there is provided cleaning means for removing foreign substance that adheres to the ink discharge portion (such as the formation surface of ink discharge ports) or recovery means for implementing the normalization of the ink flow path of the ink discharge port of the recording head. As cleaning means, there is adopted a mechanism that wipes and cleans the formation surface of the discharge port of a recording head mainly by use of a flexible wiper (wiping member).

Also, as recovery means, a recovery device is used for closely capping the formation surface of a discharge port of a recording head mainly when recording is not in operation so as to cover the ink discharge port by use of a cap (hereinafter, may also be referred to as "to execute capping"), while sucking ink from the ink discharge port through the cap by use of suction means, such as a pump. The recovery device exhausts the ink, which is no longer suitable for recording, to a waste-ink container arranged on the downstream side of the suction means. In this manner, the recovery operation is performed to implement the normalization of the ink discharge port or ink flow path. As the pump that forms the suction means, there are practically in use a pump of cylinder piston type, a pump that utilizes the deformation of a cap made of elastic material, and a tube pump or the like. Among them, the tube pump is widely used as suction means for a printer of disk top type, because it has a wider range within which it can recognize the suction pressure or suction amount so that the suction pressure or suction amount can be set comparatively freely by use of a pump of one and the same structure with a high adaptability to various kinds of products, although it is not suitable for use aiming at downsizing like a pump of the cylinder piston type. Also, in the waste ink container, there is at least provided a waste ink absorbent in order to retain waste ink exhausted from the pump.

At present, the waste ink absorbent that is installed for the recording apparatus is formed by 100% virgin cellulose fiber.

However, the waste ink absorbent formed by 100% virgin cellulose fiber is expensive. Also, in order to enable the waste ink absorbent to sufficiently demonstrate its ink collection capability, a structure, such as disclosed in the specification of Japanese Patent Laid-Open Application No. 2000-135797, is adopted so that a sheet layer of synthetic fiber is laminated on the surface of the waste ink absorbent, for example. In this case, the structure of the waste ink absorbent becomes complicated, which invites more increase of costs inevitably.

Now, along with the advancement of technologies, environmental consideration is prerequisite, and the recycling capability of a product or the reusability thereof should be considered more. From the viewpoint that such trends should be taken into account, studies have been made assiduously to reconsider the structure of waste ink absorbent using virgin cellulose fiber. Conceivably, it is possible to utilize recycling or recycled material, such as used paper, positively for the structure of waste ink absorbent with the environmental problem in view.

In the course of the studies thus made, it has been found that a buffer that absorbs shocks given to a product at the time of distribution or delivery is a structure formed by the utilization of cellulose fiber such as used paper. For such buffer, there are the one produced in a dry method of manufacture as disclosed in the specification of Japanese Patent Laid-Open Application No. 9-78500 (U.S. Pat. No. 5,785,817) and those produced by wet methods of manufacture as disclosed in the specifications of Japanese Patent Laid-Open Application No. 2000-119999 and Japanese Patent Laid-Open Application No. 2000-120000, among some others. Here, however, if a buffer produced by the dry method is used as a waste ink absorbent, the bound fibers themselves are peeled off when absorbing ink and the shape of the buffer is collapsed to pieces. A buffer of such kind is not high in the ink absorbing capability fundamentally, and it cannot absorb waste ink as sufficiently as anticipated. This material is not satisfactory when used as the waste ink absorbent for an ink jet recording apparatus. On the other hand, the buffer produced by a wet method has a good ink absorbing capability as compared with the one produced by the dry method. Nevertheless, when absorbing ink, the buffer becomes breakable so as to make it difficult to handle, because the shape thereof is easily collapsed.

After all, although the material that has been proposed as the buffer utilizes recycling material, such as old paper, in consideration of the environmental problems, the shape of such material collapses easily to make its handling capability inferior. The ink absorption that such material can perform is not sufficient, either. Consequently, it is found impossible to use such material as an ink absorbent for an ink jet recording apparatus.

Now, assuming that such buffer is installed as the waste ink absorbent for an ink jet recording apparatus, there is a fear that the waste ink absorbent is partly collapsed to lose the original shape thereof when such waste ink absorbent is installed before absorbing waste ink (that is, at the time of installation thereof in the manufacturing step of an ink jet recording apparatus) and when the waste ink absorbent is collected after having absorbed waste ink (that is, at the time of collecting the waste ink absorbent for disassembling the ink jet recording apparatus for recycling). Further, the collapsed minute portions of the waste ink absorbent at the time of installation reside in the ink jet recording apparatus as dust particles eventually, which may cause the function of ink jet recording head, the essential part of an ink jet recording apparatus, to be deteriorated, thus resulting in the lower quality of recorded images. Also, the collapsed minute portions of the waste ink absorbent reside as remainders in the ink jet recording apparatus at the time of the recycling operation, which may stand in the recycling performance of the ink jet recording apparatus.

There is also a fear that the waste ink, which has not been absorbed by waste ink absorbent formed by the buffer, the ink absorptive performance of which is inferior, leaks from the portion where the waste ink absorber is contained when such buffer is used as the waste ink absorber for an ink jet recording apparatus. Further, there is a fear that the containing portion of such waste ink absorber presents discoloration due to contact with the waste ink that has not been absorbed by the waste ink absorber for a long time if the waste ink containing portion is formed by synthetic resin, and that the recycling thereof becomes impossible. Particularly, when the containing portion of such waste ink absorbent is formed as a part of the housing of the apparatus main body, there is a fear that the recycling possibility of the entire housing is lost.

Also, the conventional waste ink absorbent is formed by unwoven fibrous cloth. Therefore, the fiber that forms the absorbent becomes fine feather-like fluff, and there is a fear that such fluffs scatter in an ink jet recording apparatus. Such scattered fluffs may in some cases spoil the function of the ink jet recording head, which is the essential part of an ink jet recording apparatus, resulting in the lowered quality of recorded images.

SUMMARY OF THE INVENTION

It is an object of the present invention to provide an inexpensive porous absorbent that can be formed using recycling materials, which presents an excellent capability of absorbing ink or the like and an excellent handling performance as well. It is also the object of the invention to provide an ink jet recording apparatus having such porous absorbent installed thereon.

More specifically, the invention is designed to aim at the provision of a porous absorbent to be installed on an ink jet recording apparatus, which is capable of demonstrating a sufficient ink collection performance when used as a waste ink absorbent for an ink jet recording apparatus, while it is made easier to collect the absorbent assuredly when the ink jet recording apparatus is disassembled for recycling, thus contributing to recycling of an ink jet recording apparatus in a better condition. The invention is also designed to aim at the provision of an ink jet recording apparatus having such porous absorbent installed thereon.

It is another object of the invention to provide a porous absorbent capable of suppressing the scattering of fiber as fluffs, and also, to provide an ink jet recording apparatus having such porous absorbent installed thereon.

The porous absorbent of the invention is characterized in that it contains at least virgin fiber, old paper fiber of waste newspaper, and hemp fiber.

The porous absorbent of the invention is characterized in that slurry having natural fiber or synthetic fiber as the main material is dehydrated and dried for the formation of porous substance.

The ink jet recording apparatus of the invention is an ink jet recording apparatus that records on a recording medium by use of a recording head capable of discharging ink, which is provided with the porous absorbent of the invention as an absorbent for ink exhausted from the ink jet recording apparatus.

The porous absorbent of the invention can contain not only virgin fiber, but also recycling fiber (may be referred to as "waste fiber"), and can present an excellent absorption capability and a high productivity.

The porous absorbent of the invention does not show changes in the shape before and after liquid absorption, and even if recycling fiber is contained in the structural substance therefor, it has the same strength as that of an absorbent formed by 100% virgin cellulose fiber. Also, it is confirmed that the absorption capability of the porous absorbent of the invention has the liquid diffusion property superior to that of the absorbent formed by 100% virgin cellulose even if recycling fiber is contained as the structural material therefor. In other words, even when recycling fiber is contained for the porous absorbent of the invention as the structural material therefor, the wet surface of the absorbent is in contact with the air for a longer time, and it is confirmed that the porous absorbent of the invention has a superior evaporation ratio of liquid.

Also, in the description of the present invention, the term "virgin fiber" means unused fiber, which has not been utilized even once for any one of various products at all, and which includes natural fiber and synthetic fiber. The term "recycling fiber" referred to in the description of the invention means used fiber after having been utilized once for some of various products, and which includes natural fiber and synthetic fiber. The natural fiber, such as old paper or hemp fiber, that serves as the "recycling fiber" may also be referred to as a "waste natural fiber". The fiber of old newspaper disposed of by decomposing fiber as the "recycling fiber" is referred to as old paper or waste newspaper. Also, the fiber obtainable by crushing hemp bags or other hemp products may also be referred to as waste hemp fiber.

DETAILED DESCRIPTION OF THE PREFERRED EMBODIMENTS

Figure 1:
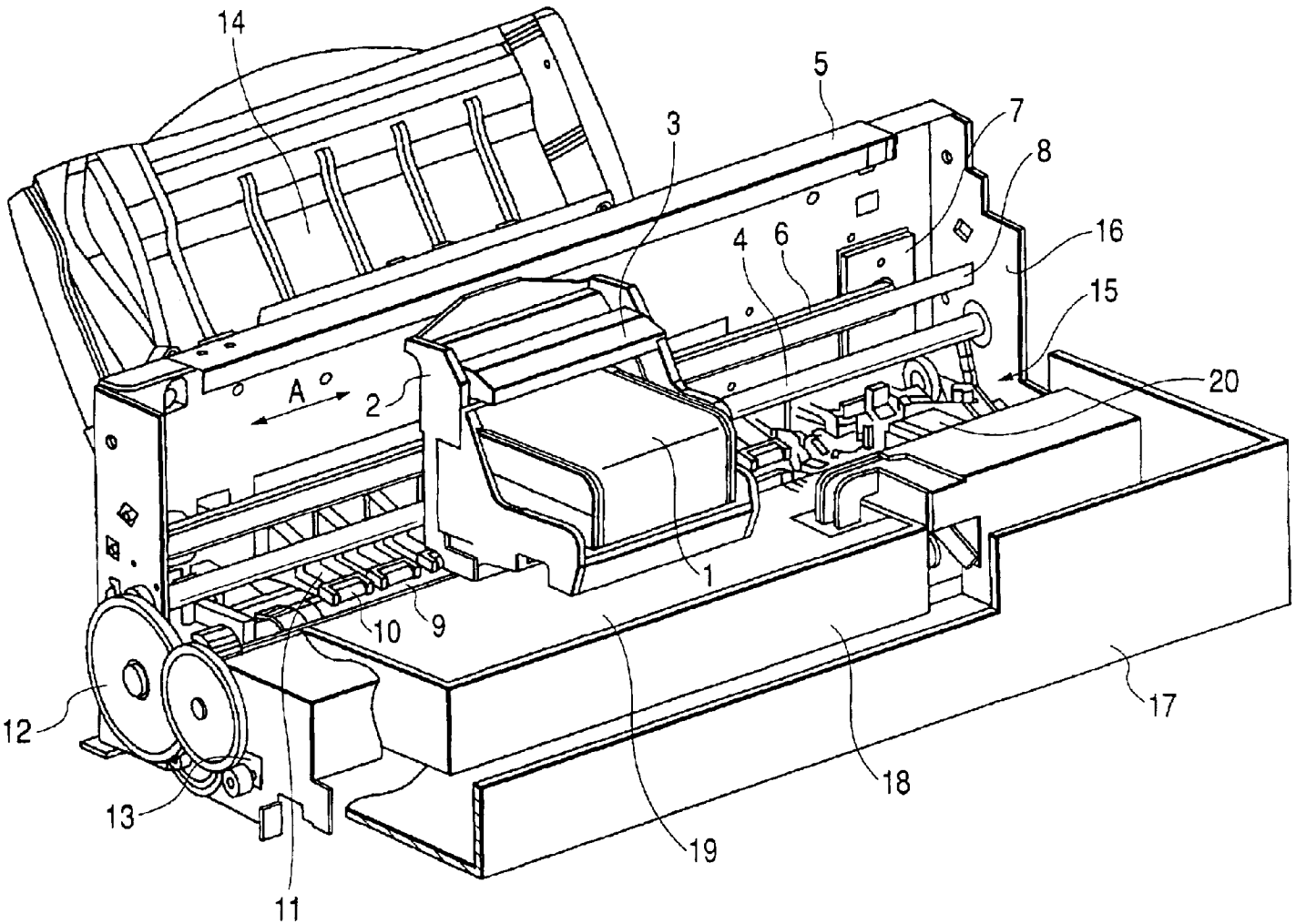
FIG. 1 is a perspective view that schematically shows the ink jet recording apparatus to which the present invention is applicable.

Hereinafter, in conjunction with the accompanying drawings, the description will be made of the embodiments in accordance with the present invention. (Structural Example of An Ink Jet Recording Apparatus) FIG. 1 is a perspective view that schematically shows the ink jet recording apparatus to which the present invention is applicable.

The ink jet recording apparatus exemplified here records images on a recording medium (not shown), such as a recording sheet, by use of a recording head cartridge 1 that discharges ink from ink discharge ports vertically downward. The recording head cartridge 1 can be structured either in such a manner that a recording head capable of discharging ink from ink discharge ports and the ink tank that supplies ink to the recording head are formed integrally or in such a manner that these are detachably coupled. Also, as the recording head, a recording head of bubble jet (registered trade name) type, which discharges ink from ink discharge ports by use of electrothermal converting elements that generate thermal energy, can be used, for example. The recording head discharges ink droplets from ink discharge ports by bubbling energy generated by film boiling of ink in the ink flow path, which is heated by the application of thermal energy generated by electrothermal converting elements.

The recording head cartridge 1 is detachably mounted on a carriage 2. The carriage 2 is supported by a guide shaft 4 and a guide rail 5 so as to reciprocate in the main scanning directions indicated by a double headed arrow A. A reference numeral 3 designates a cartridge set lever used for attaching the recording head carriage 1 to or detaching it from the cartridge 2; 6, a carriage driving belt tensioned between a driving pulley shown on the right side in FIG. 1, which is driven by a carriage motor 7, and a pulley (not shown) on the left side in FIG. 1. The carriage-driving belt 6 is connected with the carriage 2, and by means of rotational power of the carriage motor 7, the carriage 2 reciprocates in the directions indicated by the arrow A. An encoder sensor (not shown) installed on the carriage 2 reads an encoder scale 8 to detect the traveling position of the carriage 2.

A recording sheet conveyance roller 9 is connected with a carrier motor 13 through driving power transmission means 12 formed by a gear train. A pinch roller 10 is rotatively supported by a pinch roller holder 11, and biased to the recording sheet conveyance roller 9 side by means of biasing means (not shown). An automatic sheet feeder 14 separates stacked recording sheets (recording mediums) one by one for feeding. Recovery means 15 performs a recovery process in order to maintain normal discharge of the recording head cartridge 1. A reference numeral 16 designates a chassis; 18, a waste ink container having a waste ink absorbent (porous absorbent) 19 incorporated therein; and 17, a lower case formed integrally with the waste ink container 18. Above the lower case 17, an upper case (not shown) is provided for containing the inner mechanism therefor.

Figure 2:
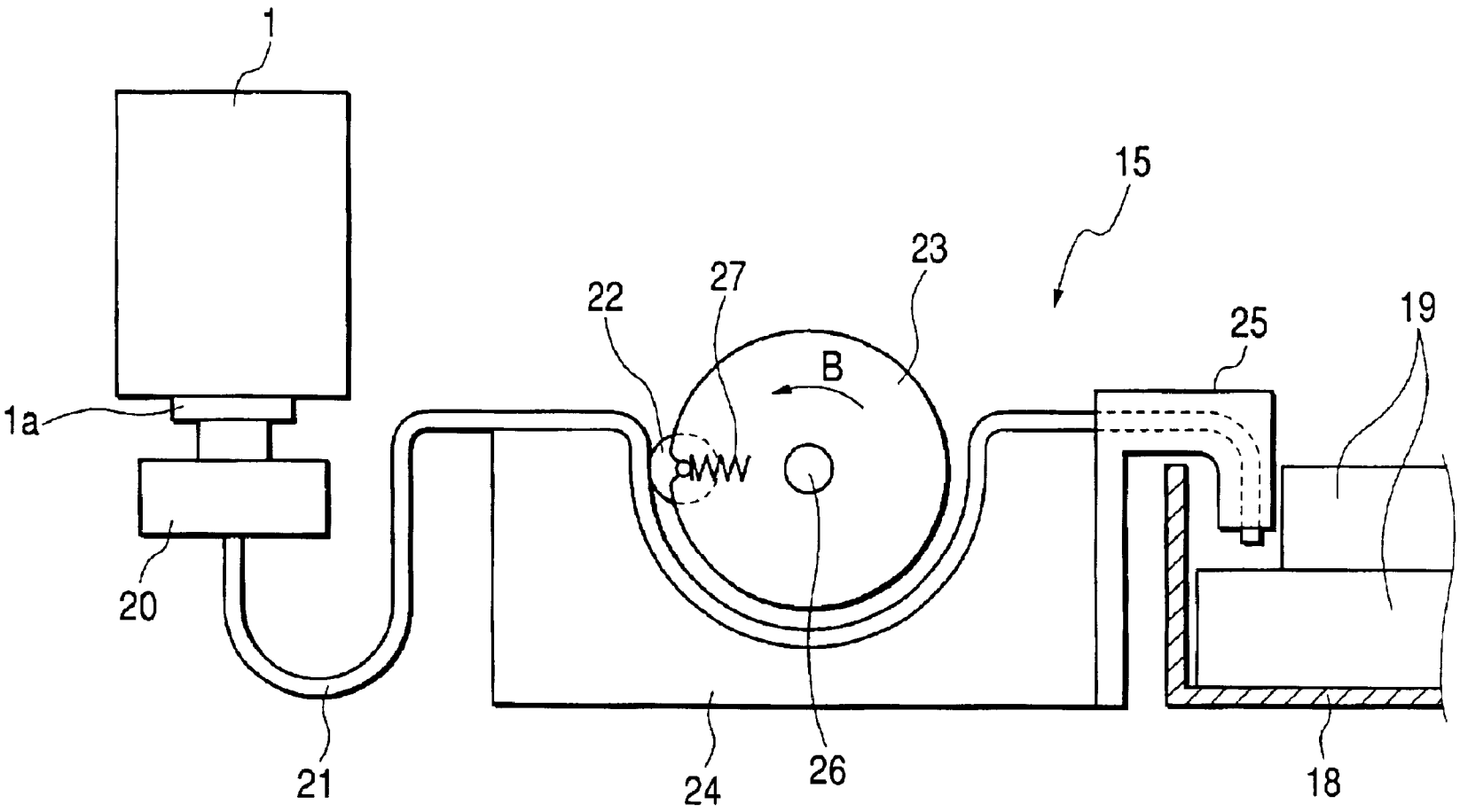
FIG. 2 is a side view that schematically shows recovery means of the ink jet recording apparatus represented in FIG. 1.

FIG. 2 is a view that schematically shows recovery means 15 for the ink jet recording apparatus represented in FIG. 1.

A reference numeral 20 designates a cap formed by an elastic member, such as rubber, which covers closely the ink discharge port portion 1*a* of a recording head cartridge 1; 21, a tube formed by elastic member, such as rubber, which is connected with the cap 20 airtightly; 24, a tube guide for holding the tube 21; and 23, a roller guide that rotates, while holding a roller 22, which generates negative pressure in the cap 20 for suctioning ink when the roller 22 squeezes the tube 21.

The rotational driving shaft 26, which is in the center of the roller guide 23 and is coupled with a driving power source (not shown) that works dedicatedly or dually for the other driving operations through driving power transmission means (not shown), rotates in the direction indicated by an arrow B by the rotational force generated by the driving power source. The roller 22 is installed on the roller guide 23 by use of a biasing spring 27 and rotates in the direction indicated by the arrow B together with the roller guide 23 so as to squeeze the tube 21, while squeezing the tube 21 in a regulated amount by means of the biasing force of the biasing spring 27. With the tube 21 being squeezed in such a manner, negative pressure is generated therein, and with the induction of such negative pressure to the cap 20, the ink, which is no longer suitable for recording, is compulsorily suctioned and exhausted from the ink discharge ports of the recording head cartridge 1, hence making it possible to maintain the normal ink discharge condition of the recording head cartridge 1.

The ink, which is suctioned and exhausted in this manner, is exhausted as waste ink from the right-side end of the tube 21 in FIG. 2 by the rotation and the squeezing operation of the roller 22 in the direction indicated by the arrow B. The end of the tube 21 on the right side is positioned in the waste ink container 18 by means of tube positioning portion 25. The waste ink, which is exhausted to the waste ink container 18 from the end of the tube 21 on the right side, is absorbed and retained by a porous waste ink absorber 19. (First Structural Example of the porous Absorbent)

Next, the description will be made of a first structural example of the porous absorbent of the present invention, which is applicable as the waste ink absorbent 19 shown in FIG. 2.

The porous absorbent of the present invention (hereinafter, simply referred to as an "absorbent") is formed by a wet method of manufacture with natural fiber or synthetic fiber as the structural material therefor. For example, a slurry is prepared by dispersing the old paper fiber, which serves as a waste natural fiber, in the water at first, and then, the slurry is injected into a mold. The concentration of the slurry is usually adjusted within a range of 0.03 to 10 wt % of dry solid portion. In order to obtain a better condition of dispersion, it is preferable to prepare such concentration within a range of 0.03 to 5 wt %. Then, the moisture content of the dispersed medium is dehydrated from the slurry in the mold. The molded object in a wet condition is dried by use of known means, such as hot blast drying or infrared drying, thus producing the absorbent. Fiber having the Canada Standard Freeness (CSF) of 550 ml or more is used as the natural fiber or synthetic fiber that forms the absorbent. The Canada Standard Freeness is regulated by JIS-P-8121, which is usually the value that indicates the freeness property of pulp. Here, it has been confirmed that by use of fiber having the Canada Standard Freeness of 550 ml or more, the absorbent has an excellent liquid absorption.

Also, as the natural fiber or synthetic fiber, which forms the absorbent, it is preferable to use fiber having a value of dehydration speed of 20 seconds or less by the Ohken method. The dehydration value of the Ohken method is measured by use of a 400 mm high and 83 mm Φ acrylic resin cylindrical container, which is provided with an 80-mesh stainless steel wired bottom plate. In other words, a target fiber for measurement having a dry weight of 24.3 g is agitated and dispersed in 1,596 cc of water to prepare a slurry having 1.5% solid concentration, which is put into the acrylic resin cylindrical container 30 minutes after the preparation of the slurry. Then, by means of suction dehydration of 350 mHg from the bottom of the acrylic resin cylindrical container, the time (seconds) that it may take until the liquid surface reaches a level 10 mm high from the bottom plate is the value of a dehydration speed of the Ohken method. In a case of old paper fiber, it should be good enough if old paper is formed into the single fibrous condition thereof by means of dry resolution, and then, the fiber having a dry weight of 24.3 g is agitated and dispersed in the water of 1,596 cc to prepare a slurry having a solid concentration of 1.5%. In this manner, a porous substance having an excellent absorption is formed, because by use of fiber having a value of dehydration speed of 20 seconds or less by the Ohken method as the substance that forms the absorbent, close contact between fibers is suppressed when the slurry is dehydrated (by suction or the like).

Also, as the natural fiber that forms the absorbent, it is possible to use specifically at least one kind of those selected from the following groups (1), (2), and (3).

(1) An appropriate cellulose fiber: for example, fiber of natural wood pulp (virgin cellulose fiber), such as chemical or mechanical pulp of unused conifer or broadleaf tree, which is usually used for paper making.

(2) An appropriate fiber of non-natural wood pulp, such as hemp or cotton.

(3) Waste natural fiber, such as old paper or wasted hemp, which has been once used.

As the fiber of natural wood pulp, the curled fiber (manufactured by U.S. Wayerhaeuser Inc.) and some others, which are widely known in the industry, are mainly usable. Also, as old paper (waste old paper), there are newspaper, books, magazines, telephone directories, catalogues, quality paper, packaging boxes, cardboard boxes, pulp molds, paper buffers, which have been used once, cut-off paper, spoilage, or others made available for recycling among those discarded from factories or business sites for dealing with paper carding, printing, book making, box making, cardboard manufacturing, or the like. As waste hemp fiber, there are usable hemp, ramie hemp, flax, yellow hemp (jute), kenaf, sisal, bow hemp, Manila hemp, New Zealand hemp, and others, which are known in the industry, or those which are usually discarded as the objects that cannot be recycled. The hemp fiber functions to form gaps in an absorbent for improving the freeness of the absorbent.

Also, when using synthetic fiber as the one that forms an absorbent, it is possible to use at least one kind selected from among polyester or rayon groups, which provide liquid absorptive capability appropriately as the synthetic fiber to serve the purpose. In other words, the synthetic fiber that provides liquid absorptive capability is usable.

Also, it is desirable to arrange the apparent density of the absorbent to be 0.02 g/cm$^3$ or more and 0.40 g/cm$^3$ or less. If the density of the absorbent is less than 0.02 g/cm$^3$, the entanglement of fibers themselves is weak when moisture content is suctioned at the formation stage of the absorbent, thus making the productivity of the absorbent unfavorable. Further, excessive gaps are formed in the absorbent, and there is a fear that liquid leaks after liquid is absorbed. On the other hand, if the apparent density of the absorbent is more than 0.40 g/cm$^3$, gaps become too small to make the absolute amount of liquid absorption insufficient. It is more preferable to arrange the apparent density of the absorbent to be 0.10 g/cm$^3$ or more and 0.25 g/cm$^3$ or less. The effectiveness of specific apparent density of the absorbent can be evaluated by checking the three items: the presence and absence of changes in shapes before and after liquid absorption by the absorbent, the absorption performance thereof, and the productivity. In other words, if the apparent density of the absorbent is less than 0.10 g/cm$^3$, the configuration is collapsed after liquid absorption to reduce the liquid retaining power thereof. If the apparent density of the absorbent is more than 0.25 g/cm$^3$, the configuration becomes hard to make it easier to expand after liquid absorption.

Also, the absorbent may be formed in such a manner that it contains waste natural fiber in an amount of 10% or more with the remaining portion being fiber of natural wood pulp. It is possible to form the absorbent with structural material having one component, too, but it takes time to dry an absorbent of 100% waste natural fiber at the stage of production, and the cost of manufacture tends to be higher. On the contrary, if the distribution ratio of waste natural fiber is made less than 10% for producing the absorbent, the anticipated advantage of recycled waste natural fiber becomes less. In this aspect, there is almost no significant difference between this one and the one produced only by natural fiber.

Also, the absorbent can be formed as a structural substance having virgin cellulose fiber of 30 to 50% as the virgin fiber, waste newspaper fiber of 25 to 35% as the old paper fiber, and waste hemp fiber of 25 to 35% as the hemp fiber. The effectiveness of the structural ratio of an absorbent having natural fiber and waste natural fiber compounded therefore is evaluated by the three items: the presence and absence of changes in the shape of the absorbent before and after liquid absorption, the absorptive performance, and the productivity. The liquid absorptive performance of the absorbent does not show any significant changes even if the structural ratio is altered. However, the drying property of an absorbent at the time of its manufacture is such that the virgin cellulose fiber has a faster speed than that of waste natural fiber. Therefore, the larger the ratio of virgin cellulose fiber, the shorter becomes the time required for manufacture, thus making it possible to increase the productivity. Studies have been made frequently to find the way to increase the compound ratio of waste natural fiber without reducing the productivity of the absorbent. As a result, the obtained optimum structural ratio is: virgin cellulose fiber, 30 to 50%; old paper fiber of waste newspaper, 25 to 35%; and waste hemp fiber, 25 to 35%.

Also, in order to form a stabilized good-quality absorbent, it is extremely effective to arrange the numerical average of the fibrous length of the waste natural fiber that forms the absorbent to be 50 mm or less. If the numerical average of the fibrous length of such waste natural fiber is made over 50 mm, the density of the absorbent tends to be uneven after manufacture. There is also a fear that the surface of the absorbent becomes rough. It is also desirable to make the thickness of the absorbent 1 mm or more. If the thickness of the absorbent is less than 1 mm, not only the strength is made lower as an absorbent, but also the liquid absorption capability is reduced.

(Second Structural Example of the Porous Absorbent)

Next, the description will be made of a second structural example of the porous absorbent embodying the present invention, which is applicable as the waste ink absorbent 19 shown in FIG. 2.

As the method of manufacture for the porous absorbent of the present invention (hereinafter, simply referred to as an "absorbent"), there are wet and dry methods. The wet method of manufacture is such a formation method as has been described above, and the slurry, the main raw material of which is virgin fiber or recycling fiber, is dehydrated and dried in a mold for the formation of a porous substance. Also, the dry method of manufacture is such a formation method as to press and heat in a mold a material having virgin fiber or recycling fiber as the main raw material therefore.

In the formation process of such porous absorbent, it is preferable to blow gas to the surface thereof to remove dust particles adhering to the surface of the porous absorbent. Here, it is desirable to adjust the wind pressure of the blowing gas to be 1.0 MPa or less so as not to damage the surface of the porous absorbent. Also, as such blowing gas, an inexpensive one can be selected from the group of air, nitrogen, oxygen, and carbon dioxide.

Also, for the prevention of the fluffs of the structural fibers that form the porous absorbent from being scattered, it is preferable to contain the water-soluble polymer that produces an effect of binding structural fibers as one of the components of the porous absorbent. The water-soluble polymer may be contained when forming the absorbent or may be provided for the surface of the absorbent after the formation thereof. However, the fluffs that may be generated from the structural fibers of a porous absorbent are mostly those from the surface of the absorbent. Therefore, it is preferable to provide such water-soluble polymer for the absorbent after the formation thereof for the effective prevention of the fluff scattering with as small an amount of the water-soluble polymer as possible.

Also, as the water-soluble polymer, it is possible to use that of the polysaccharide class, protein class, or thermoplastic resin class. Also, if starch, carboxyl methyl cellulose, gelatin, glue, polyvinyl alcohol, poly acrylic soda, polyethylene glycol, polypropylene glycol, or the like is used as the water-soluble polymer, such substance does not react with the components of waste ink when the porous absorbent absorbs waste ink, and functions to prevent fluff scattering without hindrance to the waste ink absorption capability thereof. Also, the water-soluble polymer effectively prevents fluff scattering without impeding the waste ink absorption capability of the porous absorbent with an amount of 0.001% or more and 5% or less of the weight of the absorbent. Also, when the water-soluble polymer is provided after the formation of the absorbent, it is preferable to enable the absorbent to contain the water-soluble polymer thinner and wider as much as possible, because if the water-soluble polymer is contained locally in a large amount, there is a fear that the ink absorption property of the absorbent is reduced. Therefore, it is desirable to adopt a method for providing the water-soluble polymer by spraying it in the form of mist, rather than in the form of liquid, so that the absorbent contains it appropriately.

Now, hereinafter, the description will be made of specific embodiments in accordance with the present invention.

(First Embodiment)

In accordance with the present embodiment, the absorbent is formed by virgin cellulose and waste natural fiber. As the virgin cellulose, the fiber of curled fiber pulp is used. Also, as the waste natural fiber, fibers of old newspaper and hemp are used. The old newspaper is given fiber decomposition treatment, and hemp fiber is obtained by cutting jute hemp bags by use of a cutting machine, and then, crushed by use of a crusher. A mixed substance thus obtained, which contains 40% (dry weight) of virgin cellulose fiber, 30% (dry weight) of waste old newspaper fiber, and 30% (dry weight) of waste hemp fiber, is provided with water to adjust it to contain a solid concentration of 2%, and then, sufficiently agitated to obtain a slurry. The slurry is put into a mold, and the moisture content thereof is suctioned sufficiently. Hot blast is given at a temperature of 150° C. for 3 minutes under a pressure of 1 kg/cm$^2$, thus drying the formed substance in the mold. The formed substance, that is, an absorbent, has a concentration of 0.20 g/cm$^3$.

This absorbent is used as waste ink absorbent (corresponding to the "waste ink absorbent 19" in FIG. 2), and installed in the waste ink-absorbing portion (corresponding to the "waste ink-absorbing portion 18" in FIG. 2) inside an ink jet printer (Canon BJF-870). The volume of the absorbent is approximately 640 cm$^3$. Then, with the ink jet printer thus arranged, the aforesaid recovery operation, that is, the recovery operation to implement the normalization of ink discharge ports and ink flow paths thereof, is continuously carried out to absorb the BJ ink (BCI-6 ink for use of the Canon BJF-870), which is suctioned from the discharge ports and exhausted to the absorbent. This recovery operation is arranged to repeat for 50 minutes. During such period of time, BJ ink of approximately 70 ml is absorbed. After that, the absorbent is left intact for 24 hours at the room temperature under the normally pressurized environment for drying. This operation is repeatedly executed for one week in order to evaluate the presence and absence of changes in the shape of the absorbent before and after ink absorption, the retaining condition of ink, the conditions of liquid diffusion due to temporal changes, and the liquid evaporation ratio.

As a result, it is confirmed that the absorbent of the present embodiment is excellent in the condition of ink diffusion. With such excellent ink diffusion capability, the surface of the absorbent, which is wet with ink, is in contact with the air for a long time. As a result, ink absorbed in the absorbent is evaporated efficiently during the period of being left intact per 24 hours. Given the absorbed ink evaporation ratio as (a total amount of ink evaporated)/(a total amount of ink absorbed by recovery operation)×100, such rate is approximately 15%. This evaporation ratio means a rate at which the absorption capability is recovered as the surface of the absorbent is dried. Therefore, during such experiment as this, the absorption performance of the absorbent is not lowered at all, and waste ink is totally absorbed and retained in the absorbent, and there is no leakage of waste ink from the waste ink-absorbing portion at all. Also, when the absorbent absorbs ink, it does not expand, and there is no change in the shape thereof. In this way, the absorbent of the present embodiment has an excellent absorption capability, serving as an absorbent using old paper and hemp fiber with consideration given to environment.

(Second Embodiment)

In accordance with the present embodiment, an absorbent is produced in the same manner as the first embodiment described above. Then, the absorbent thus produced, which is used as the waste ink absorbent (corresponding to the "waste ink absorbent 19" in FIG. 2), is installed in the waste ink-absorbing portion (corresponding to the "waste ink-absorbing portion 18" in FIG. 2) of the ink jet printer (Canon BJF-870). The volume of the absorbent is approximately 640 cm$^3$. This ink jet printer is used in an office for one year. During the period of such use, the aforesaid recovery operation that implements the normalization of the ink discharge ports or ink flow paths is performed as set by the manufacture without any restriction. In this office, the ink jet printer operates by recording on approximately 100 to 200 recording sheets per day. After one year's use of the ink jet printer in such a manner, evaluation is made as to the presence and absence of changes in the shape of the absorbent before and after its ink absorption, the retaining condition of ink, the liquid diffusion capability caused by changes as the time elapsed, and the drying condition of the absorbent.

As a result, it is found that owing to the excellent ink diffusion capability of the absorbent, the surface of the absorbent, which is wet with ink, is in contact with the air for a long time, and the surface of the absorbent is dried completely. Therefore, during such experimental period, the absorption performance of the absorbent is not reduced, and all the exhausted waste ink to the absorbent is absorbed and retained therein. There is no leakage of ink from the waste ink-absorbing portion at all. Also, the absorbent is removed from the waste ink-retaining portion, and the condition of ink adhesion to the absorbent is examined by eyesight, with the result that ink is completely retained by the absorbent. Also, the absorbent is not expanded even when it absorbs ink, hence observing no change in the shape thereof. As described here, the absorbent of the present embodiment, which is given environmental consideration, demonstrates excellent absorption capability under the use environment of the user.

(Example Comparing with the First Embodiment)

The absorption capability of the absorbent of the first embodiment described above is compared with that of the conventional absorbent (corresponding to the "waste ink absorbent 19" in FIG. 2), which is installed in Canon ink jet printer (BJF-870). The conventional absorbent serving as this comparing example is formed only by virgin cellulose. This conventional absorbent and the aforesaid absorbent of the first embodiment are installed, respectively, in the waste ink-absorbing portions inside ink jet printers (Canon BJF-870). The volumes of the absorbents are approximately 640 $cm^3$ each.

Then, the recovery operation of an ink jet printer as described earlier, that is, the recovery operation to normalize ink discharge ports or ink flow paths, is continuously carried out so as to exhaust BJ ink (Canon BCI-6 ink used for Canon BJF-870) as waste ink to the absorbent for absorption thereof, respectively. This operation is repeated for a period of 50 minutes, during which approximately 70 ml of BJ ink is absorbed by each of the absorbents. After that, each of the absorbents is left intact for 24 hours at room temperature under a normally pressurized environment to enable each of them to dry. While this operation is repeated for one week, comparison between them is made as to the presence and absence of changes in the shape before and after ink absorption, the retaining condition of ink, the liquid diffusion capability due to changes as the time elapses, and the evaporation ratio.

As a result, there is no change in the shape of either absorbent before or after ink absorption. The ink, which is exhausted as waste ink, is completely retained, and no ink leakage from the absorbent is observed. As to the ink diffusion capability, however, the absorbent of the first embodiment is superior to the conventional absorbent. The excellent ink diffusion capability means that the surface of the absorbent wet with ink is in contact with the air for a long time. Therefore, the absorbent of the first embodiment is superior to the conventional one as to the ink evaporation ratio. The ink evaporation ratio is obtained by the formula of (the total amount of ink evaporated)/(the total amount of ink absorbed by recovery operation)×100, with the result that whereas the evaporation ratio of the conventional absorbent is approximately 10%, the absorbent of the first embodiment is approximately 15%. With the comparison thus made, it is confirmed that the absorbent of the first embodiment, which is given the environmental consideration, is superior to the conventional absorbent formed by 100% virgin pulp serving as natural virgin fiber in the aspect of absorption capability.

(Third Embodiment)

As shown in Table 1, nine porous absorbents (samples 1 to 9), each having different structural materials and different ratios of structural materials, are produced in the same method as the first embodiment. In Table 1, C designates the virgin pulp fiber which is virgin fiber; W, old paper pulp; J, hemp fiber; and E, a substance having a thermo-fusion property. For example, the sample 9 is formed by the virgin pulp C, hemp J, and old paper W, and substance E having thermo-fusion property in a ratio of 50:15:30:5. The substance having thermo-fusion proper is good enough if only it has the capability to bond and fix fibers when heated, and the shape thereof may be in any one of the forms of fiber, powder, or grain, among some others or these may be mixed for use. As the substance having thermo-fusion property, there is at least one kind selected from among the groups of polyethylene, ethylene acetic vinyl, and polypropylene polymeric polyester.

TABLE 1

| Sample structure | | |
|---|---|---|
| Sample No. | Mixing ratio of Structure Materials | Structure Materials |
| 1 | C/W (70/30) | Mixture of virgin pulp and old paper |
| 2 | C/W (50/50) | Mixture of virgin pulp and old paper |
| 3 | C/W (30/70) | Mixture of virgin pulp and old paper |
| 4 | C/W/E (65/30/5) | Mixture of virgin pulp, old paper and thermo-fusion-substance |
| 5 | C/W/E (45/50/5) | Mixture of virgin pulp, old paper and thermo-fusion-substance |
| 6 | C/W/E (25/70/5) | Mixture of virgin pulp, old paper and thermo-fusion-substance |
| 7 | C/J/W (50/20/30) | Mixture of virgin pulp, hemp and old paper |
| 8 | C/J/W (40/30/30) | Mixture of virgin pulp, hemp and old paper |
| 9 | C/J/W/E (50/15/30/5) | Mixture of virgin pulp, hemp, old paper and thermo-fusion-substance |

As regards the samples 1 to 9 thus prepared, the performance tests are carried out as to the performance required for waste ink absorbent. In accordance with the present embodiment, the performance tests are executed for the samples 1 to 9 and the conventional product having 100% virgin fiber (waste ink absorbent) as regards the suction height of ink, the evaporation ratio of ink, the retaining amount of ink, the expansion coefficient, and costs. The test samples are adjusted to be 2 cm wide×20 cm long×1 cm thick.

Figure 3:
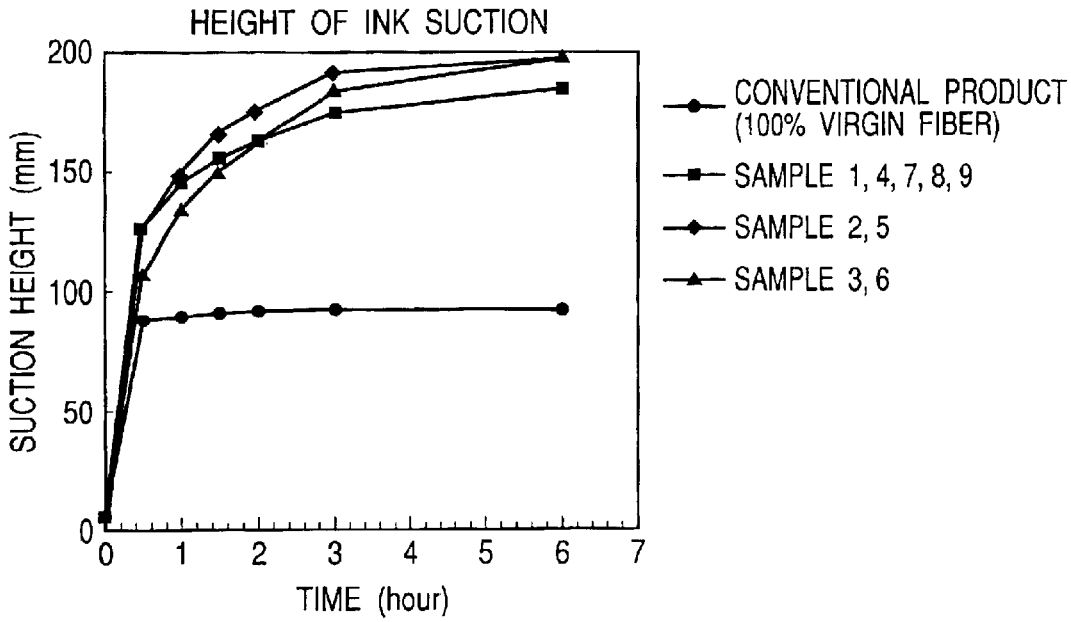
FIG. 3 is a view that illustrates the results of performance examination of samples indicated on the Table 1.

FIG. 3 shows the test result as to the suction height of ink. The axis of the abscissa in FIG. 3 indicates the elapsed time since the lower face of the sample is in contact with ink, and the axis of the ordinate indicates the height of ink absorbed in the sample. From the representation of FIG. 3, it is understandable that all the samples 1 to 9 have an ink diffusion capability of almost twice as much as compared with the conventional product formed by 100% virgin fiber. It is required for the waste ink absorbent to execute the performance that absorbs a large quantity of ink. The better such performance, the more the ink diffusion capability is enhanced. In the aspect of such performance, it is known that all the samples 1 to 9 are superior to the conventional product having 100% virgin fiber. Also, it is required for the waste ink absorbent to perform absorption instantaneously for the ink, which is exhausted in a large amount in a short period of time. The better such performance, the more acute is the rising angle of the characteristic curve shown in FIG. 3. Therefore, in the aspect of such performance, all the samples 1 to 9 are superior to the conventional product having 100% virgin fiber. Particularly, it is found that the samples 1, 2, 4, 5, and 7 to 9 are excellent.

Next, the sample absorbents are once immersed in ink to absorb it sufficiently. Then, weights are measured. In this way, the retaining amounts of ink are calculated per unit volume both for the samples 1 to 9 and the conventional absorbent. As a result, it is found that both the samples 1 to 9 and the conventional absorbent present almost the same retaining amount.

Also, as to changes in the thickness (expansion coefficient) when ink is absorbed, tests are made both for the samples 1 to 9 and the conventional absorbent having 100% virgin fiber, with the result that both the samples 1 to 9 and the conventional absorbent have almost the same expansion coefficient. It is desirable that a waste ink absorbent does not expand largely.

Figure 4:
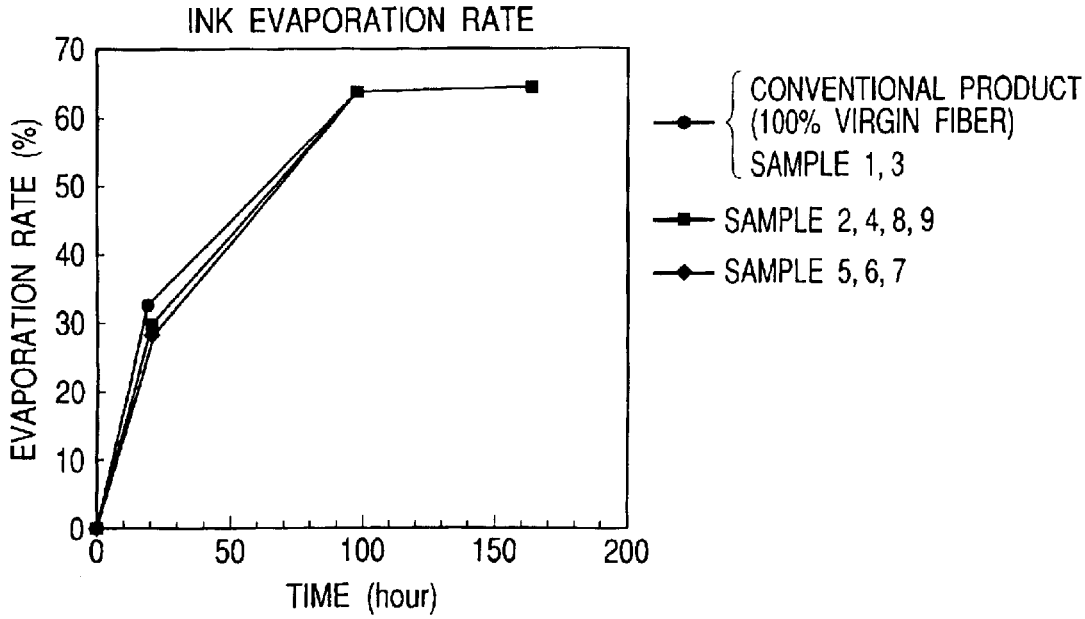
FIG. 4 is a view that illustrates the results of another performance examination of samples indicated on the Table 1.

After that, the absorbents that have absorbed ink sufficiently are left intact for a specific period of time to enable the absorbed ink to evaporate. FIG. 4 shows the rest results as to the evaporation coefficients. It is required for waste ink absorbent to be provided with such capability as to evaporate absorbed ink earlier to recover the ink absorption performance. In this aspect of performance, the samples 1 to 9 are slightly inferior to the conventional absorbent having 100% virgin fiber at the early stage of evaporation, but it is found that both of them demonstrate the same capability at the end.

Also, regarding the cost of manufacture, the samples 1 to 9 and the conventional product having 100% virgin fiber are compared, with the result that the conventional product is most expensive, and the samples 3 and 6, which contain 70% old paper, are the next most expensive. The absorbent that contains old paper in a quantity of more than 50% takes time when dried at the time of manufacture. Therefore, it is desirable to make the containing amount of old paper 50% or less from the viewpoint of manufacturing cost.

As the result of the performance test described above, it is confirmed that the samples 7 to 9 that contain hemp fiber demonstrate the function of waste ink absorbent satisfactorily. The samples 7 to 9 contain 40 to 50% of virgin pulp (natural virgin fiber) C; 15 to 30% of hemp J, with other components being old paper W and a thermo-fusion substance E. Also, the hemp J maintains the shape of absorbent by the fiber thereof and prevents the shape of the absorbent from being collapsed or broken off when it is handled, contributing to the enhancement of handling capability of absorbent thus formed.

(Fourth Embodiment)

The absorbent of the present embodiment is formed by cellulose fiber and polyvinyl alcohol, which is a water-soluble polymer. The method for formation thereof is such that water is added to a mixture of 97% (dry weight) of cellulose fiber and 3% (dry weight) of polyvinyl alcohol to adjust the solid concentration to 2%, thus obtaining a slurry by means of sufficient agitation. This slurry is put into a mold, and after sufficient suction of moisture content, hot blast is applied at a temperature of 150° C. for 3 minutes under a pressure of 1 kg/cm$^2$. In this manner, the formative substance is the mold is dried, thus obtaining a porous absorbent.

After that, the porous absorbent is dried sufficiently, and the air is blasted for approximately 15 seconds under a wind pressure of 0.3 MPa to remove dust particles adhering to the surface of the absorbent.

Then, the amount of scattered fluffs from the porous absorbent is confirmed. The method of confirmation is such as to beat the porous absorbent with a hard stick to generate fibrous fluff forcefully, hence confirming the amount of fluff generation by eyesight. Here, by eyesight, no generation of fibrous fluff from the porous absorbent is observed. Next, the porous absorbent is installed as waste ink absorbent (corresponding to the "waste ink absorbent 19" in FIG. 2) in the waste ink-absorbing portion (corresponding to the "waste ink-absorbing portion 18" in FIG. 2) inside an ink jet printer (Canon BJF-870). During this operation, it is confirmed that there is no generation of fluffs from the surface of the absorbent. Next, the ink jet printer main body having the absorbent installed therein is packed in a state of the finished product, and then, a vibrating drop is repeated per hour in each of the three axial directions of x, y, and z in order to confirm the condition of fluff generation on the sheet passage portion and recording portion of the ink jet printer main body using eyesight, with the result that no generation of fluffs is observed.

Subsequently, the aforesaid recovery operation, that is, the recovery operation to normalize ink discharge ports or ink flow paths, is continuously carried out for the ink jet printer to exhaust ink (Canon BCI-6 ink for use of Canon BJF-870) to the absorbent. Then, recording is performed to check the recording result. Here, it is confirmed that there is no disabled ink discharge, nor any recording void of characters or the like. It is also confirmed that there is no defect in the recovery operation of the recording head.

Also, for the porous absorbent of the present embodiment, examination is made as to changes in ink absorption characteristics that may be brought about by addition of water-soluble polymer. The ink absorption characteristics are evaluated for each of the items of the ink absorption property, the ink retaining ratio, the expansion coefficient of the absorbent, and the ink evaporation ratio. As a result, it is confirmed that there is almost no difference in ink absorption characteristics between the porous absorbent of the present embodiment and the porous absorbent to which a water-soluble polymer is not added. After that, the absorbent of the present embodiment having ink absorbed therein is removed from the ink jet printer, and left intact for approximately one month under an environment having a temperature of 35° C. with a humidity of 90% for the examination of the surface changes of the absorbent, with the result that there is no generation of mold or the like on the surface of the absorbent.

Also, it is possible to add water-soluble polymer to the absorbents of the first to third embodiments as in the case of the present embodiment.

(Fifth Embodiment)

In accordance with the present embodiment, an absorbent is formed by cellulose fiber. After the formation of this absorbent, the air is blasted thereto for a period of approximately 15 seconds under a wind pressure of 0.3 MPa so as to remove the dust particles adhering to the surface of the absorbent during the formation process. Then, a polyvinyl alcohol solution of 1.0 wt %, which is a water-soluble polymer, is vaporized on the surface of the absorbent. The vaporization is conducted for a period of approximately 15 seconds. The amount of water-soluble polymer is, in this case, that of 0.5% of the weight of the porous absorbent.

Subsequently, the absorbent is dried sufficiently, and the effect of the vaporization of water-soluble polymer is confirmed. The method therefor is such as to beat the porous absorbent using a hard stick to generate fiber fluff forcefully. The amount of fluff generation is confirmed by eyesight. Here, no fluff generation form the porous absorbent is observed by eyesight. Next, the porous absorbent that serves as a waste ink absorbent (corresponding to the "waste ink absorbent 19" in FIG. 2) is installed in the waste ink-absorbing portion (corresponding to the "waste ink-absorbing portion 18" in FIG. 2) inside an ink jet printer (Canon BJF-870). During this operation, there is observed no generation of fluffs from the surface of the absorbent.

Next, after the ink jet printer main body having the absorbent installed therein is packed in a state of a finished product, a vibrating drop is given thereto per hour in each of the three axial directions x, y, and z. Then, the conditions of fluff generating in the sheet passage portion and recording portion of the ink jet printer main body are confirmed using eyesight, with the result that no fluff generation is observed.

After that, for the ink jet printer, the aforesaid recovery operation, that is, the recovery operation to implement the normalization of ink discharge ports or ink flow paths, is continuously carried out to exhaust ink (Canon BCI-6 ink for use of Canon BJF-870) to the absorbent for absorption thereof. Then, after recording, the recording result is examined. Here, it is confirmed that there is no disabled ink discharge, nor any recording void of characters or the like. It is also confirmed that there is no defect in the recovery operation of the recording head.

Also, for the porous absorbent of the present embodiment, examination is made as to ascertain the changes in ink absorption characteristics brought about by the vaporization of polyvinyl alcohol. The ink absorption characteristics are evaluated for each of the items of the ink absorption property, the ink diffusion capability, the ink retaining ratio, the expansion coefficient of the absorbent, and the ink evaporation ratio. As a result, it is confirmed that there is almost no difference in ink absorption characteristics between the porous absorbent of the present embodiment and the porous absorbent to which a water-soluble polymer is not added. After that, the absorbent of the present embodiment having ink absorbed therein is removed from the ink jet printer, and left intact for approximately one month under an environment having a temperature of 35° C. with a humidity of 90% for the examination of the surface changes of the absorbent, with the result that there is no generation of mold or the like on the surface of the absorbent.

Also, it is possible to vaporize polyvinyl alcohol for the absorbents of the first to third embodiments as in the case of the present embodiment.

(Example Comparing with the Fifth Embodiment)

The amount of fluff is compared between the absorbent of the fifth embodiment described above and the conventional absorbent (corresponding to the "waste ink absorbent 19" in FIG. 2) installed in a Canon ink jet printer (BJF-870). The conventional absorbent used as the comparing sample is formed only by virgin cellulose fiber, and no process is provided for preventing fiber from being scattered.

Fluffs are generated forcibly by beating the conventional absorbent and the absorbent of the present embodiment to compare the generated amounts thereof using eyesight. As a result, the absorbent of the fifth embodiment has a distinctly smaller amount of fluff generation than the conventional absorbent. It is observed that many of the fluffs generated from the conventional absorbent present whitish fine granular diameters.

Then, the conventional absorbent and the absorbent of the fifth embodiment are installed, respectively, in the waste ink-absorbing portions of ink jet printers (Canon BJF-870). Each of the absorbents has a volume of approximately 640 $cm^3$. Here, the fluff generation of these absorbents is examined using eyesight during the installation work. As a result, the absorbent of the fifth embodiment has a smaller amount of fluff generation than the conventional absorbent. However, there is not so much difference in the amount of fluffs between them unlike the case where the absorbents are beaten by the hard stick. Further, after the printers, each having each of the absorbents installed therein, are packed in a state of the finished product, a vibrating drop is given to them per hour in each of the three axial directions of x, y, and z, and then, the conditions of fluff generating in the sheet passage portions and recording portions of the printer main bodies are confirmed using eyesight. As a result, it is found that the absorbent of the fifth embodiment has a smaller amount of fluff generation in the sheet passage portion and recording portion of the printer than the conventional absorbent. After that, for each of the ink jet printers, the aforesaid recovery operation, that is, the recovery operation to implement the normalization of ink discharge ports or ink flow paths, is continuously carried out to exhaust ink (Canon BCI-6 ink for use of Canon BJF-870) to the absorbent for absorption, with the result that the conventional absorbent generates fluffs from the surface of the absorbent, which adhere to the capping portion in the printer main body, inducing defective suction at the time of suction recovery of the recording head, and disabled discharge of ink occurs. In contrast, it is confirmed that the absorbent of the fifth embodiment does not present such defects as disabled ink discharge or voids in recorded images.

(Other Embodiments)

The absorbent of the present invention can be used as the waste ink absorbent that absorbs and retains waste ink exhausted by various recovery means, such as pre-discharge and pressurized recovery, among some others, in addition to the absorption and retainment of waste ink exhausted by the aforesaid recovery operation, that is, the process to suction and exhaust ink from the recording head or ink flow paths. The pre-discharge is a recovery process that discharges from the discharge ports of a recording head the ink which does not contribute to recording images so as to maintain the ink discharges from the recording head in good condition. The absorbent can absorb and retain ink discharged from the recording head for the execution of such recovery process. Also, the pressurized recovery is a recovery process that pressurizes the inside of a recording head so as to pressurize and exhaust ink forcibly from the discharge ports for the maintenance of the ink discharge from the recording head in good condition. The absorbent can absorb and retain ink pressurized and exhausted from the recording head for such recovery process. In this manner, the waste ink exhausted by recovery means for the pre-discharges, suction recovery, pressurized recovery, and the like is absorbed and retained in the absorbent, hence making it possible to collect waste ink exactly without staining the interior of an ink jet recording apparatus for the resultant stabilization of recording in good condition for a long time.

Also, the absorbent of the present invention is applicable as a waste ink absorbent or the like in an apparatus, such as a printer that records on paper, thread, fiber, cloth, leather, metal, plastic, glass, ceramics or other recording media, a copying machine, a facsimile machine provided with communication systems, or a word-processor provided with a printer portion, as well as in an industrial use recording system in which various processing apparatuses are complexly combined. Here, the term "recording" (may also be referred to as "printing" in some cases) in the specification hereof means not only the case where meaningful information such as represented by characters and figures, is formed, but also broadly means the case where images, designs, patterns, and others are formed on a medium, irrespective of whether or not such formation is meaningful or whether or not such formation is apparent so that a human being can recognize it visually. Here, the case where a recording medium is processed is also included. Also, the term "recording medium" means not only paper or a sheet used for a general recording apparatus, but also broadly means those capable of accepting ink, such as cloth, plastic film, metal sheet, etc. Further, the term "ink" here should be interpreted broadly, as in the definition of the aforesaid "recording", and means a liquid which is provided for the formation of images, designs, patterns, and the like or a liquid provided for processing a recording medium when applied to the recording medium.

Also, the absorbent of the present invention is usable, besides being used in a recording apparatus, for absorbing oil or solvent in order to dispose of oil leakage or solvent leakage from machines installed in an operation site in a factory or installed at home. Also, the absorbent of the present invention may be usable for absorbing and retaining various gases, besides ink, oil, solvent or the like.

As described above, the present invention makes it possible to structure a porous absorbent by use of recycling materials, which contain at least virgin fiber, old paper fiber, and hemp fiber, for the enhancement of absorption capability of ink or the like and the implementation of cost reduction as well.

More specifically, in a case where the porous absorbent is used as a waste ink absorbent for an ink jet recording apparatus, the absorbent demonstrates a sufficient ink collection capability when installed on the ink jet recording apparatus, and it can be collected simply and exactly when an ink jet recording apparatus is disassembled for recycling, thus contributing to the recycling efficiency of the ink jet recording apparatus.

Also, with the provision of a water-soluble polymer for the porous absorbent, it is possible to suppress the scattering of fibers that are caused to become fluffs.

Also, the slurry, the main material of which is natural fiber or synthetic fiber, is dehydrated and dried to form a porous absorbent. The manufacture thereof is possible by a new wet method of manufacture. Here, the porous absorbent thus manufactured can demonstrate excellent absorption capability when used for an ink jet recording apparatus or the like.

Also, as the structural fiber of the porous absorbent, old paper, hemp fiber, or other recycling fiber is used to make it possible to provide a porous absorbent with environmental considerations, which can demonstrate the same or better absorption capability than that of a 100% virgin fiber porous absorbent, thus developing new usage of old paper, hemp, and other recycling materials.

What is claimed is:

1. A porous absorbent comprising:

virgin fiber, old paper fiber, and hemp fiber, wherein a water-soluble polymer is applied to said porous absorbent and an amount of said water-soluble polymer is 0.001% or more and 5% or less of the weight of said porous absorbent.

2. A porous absorbent according to claim 1, wherein said porous absorbent contains 40 to 50% of said virgin fiber, and 15 to 30% of said old paper fiber.

3. A porous absorbent according to claim 1, wherein said virgin fiber comprises natural cellulose fiber.

4. A porous absorbent according to claim 1, wherein said virgin fiber comprises chemical pulp or mechanical pulp of unused conifer or broad leaf trees used for paper making.

5. A porous absorbent according to claim 1, wherein said old paper fiber is of waste newspaper.

6. A porous absorbent according to claim 1, wherein said hemp fiber comprises waste hemp fiber.

7. A porous absorbent according to claim 1, wherein said porous absorbent contains said virgin fiber having a numerical average of fiber length of 50 mm or less.

8. A porous absorbent according to claim 1, wherein a slurry having said virgin fiber, said old paper fiber of waste newspaper, and said hemp fiber as main materials is dehydrated and dried to form a porous substance.

9. A porous absorbent according to claim 8, wherein the amount of dried solid component of the concentration of said slurry is adjusted to be within a range of 0.03 to 10 wt %.

10. A porous absorbent according to claim 8, wherein the amount of dried solid component of the concentration of said slurry is adjusted to be within a range of 0.03 to 5 wt %.

11. A porous absorbent according to claim 1, wherein the apparent density of said porous absorbent is 0.02 g/cm$^3$ or more and 0.40 g/cm$^3$ or less.

12. A porous absorbent according to claim 1, wherein the apparent density of said porous absorbent is 0.10 g/cm$^3$ or more and 0.25 g/cm$^3$ or less.

13. A porous absorbent according to claim 1, wherein the thickness of said porous absorbent is 1 mm or more.

14. A porous absorbent according to claim 1, wherein said water-soluble polymer is at least one or more kinds selected from among the groups of polysaccharide class, protein class, and thermo-plastic resin class.

15. A porous absorbent according to claim 1, wherein said water-soluble polymer is at least one or more kinds selected from among the groups of starch, carboxyl methyl cellulose, gelatin, glue, polyvinyl alcohol, poly acrylic soda, polyethylene glycol, and polypropylene glycol.

16. A porous absorbent according to claim 1, wherein said water-soluble polymer is sprayed to be provided on the surface of said porous absorbent.

17. An ink jet recording apparatus for recording on a recording medium by use of a recording head capable of discharging ink, comprising:

a porous absorbent according to any one of claims 1–13, 14, 15 and 16 as an absorbent for waste ink exhausted from said inkjet recording apparatus.

18. An ink jet recording apparatus according to claim 17, wherein said waste ink contains at least one of ink suctioned and exhausted from ink discharge ports of said recording head, ink exhausted from the ink discharge ports of said recording head under pressure and ink discharged from said recording head but not contributing to image recording.

19. An ink jet recording apparatus according to claim 17, wherein said recording head is provided with electrothermal converting elements for generating thermal energy for discharging ink.

20. A porous absorbent formed by dehydrating and drying a slurry having natural fiber or synthetic fiber as a main material to form a porous substance, said natural fiber or synthetic fiber comprising at least virgin fiber and recycled fiber, a water-soluble polymer being applied to said porous substance, the amount of said water-soluble polymer contained being 0.001% or more and 5% or less of the weight of said porous absorbent.

21. A porous absorbent according to claim 20, wherein said natural fiber or synthetic fiber comprises fiber having Canada Standard Freeness (CSF) of 550 ml or more.

22. A porous absorbent according to claim 20, wherein said natural fiber or synthetic fiber comprises fiber having a value of Ohken type dehydration speed of 20 seconds or less.

23. A porous absorbent according to claim 20, wherein said natural fiber is at least one among cellulose fiber, fiber of non-wood natural pulp, and waste natural fiber.

24. A porous absorbent according to claim 23, wherein said cellulose fiber comprises chemical pulp or mechanical pulp of unused conifer or broad leaf trees used for paper making, said fiber of non-wood natural pulp comprises fiber of hemp, cotton, or the like, and said recycled fiber comprises waste natural fiber of old paper, waste hemp, or the like.

25. A porous absorbent according to claim 20, wherein said synthetic fiber comprises at least one kind selected from among the groups of polyester or rayon having liquid absorption capability.

26. A porous absorbent according to claim 20, wherein an amount of dried solid component of the concentration of said slurry having said natural fiber or synthetic fiber as the main material is adjusted to be within a range of 0.03 to 10 wt %.

27. A porous absorbent according to claim 20, wherein an amount of dried solid component of the concentration of said slurry having said natural fiber or synthetic fiber as the main material is adjusted to be within a range of 0.03 to 5 wt %.

28. A porous absorbent according to claim 20, wherein the apparent density of said porous absorbent is 0.02 g/cm$^3$ or more and 0.40 g/cm$^3$ or less.

29. A porous absorbent according to claim 20, wherein the apparent density of said porous absorbent is 0.10 g/cm$^3$ or more and 0.25 g/cm$^3$ or less.

30. A porous absorbent according to claim 20, wherein said porous absorbent is formed by waste natural fiber in an amount of 10% or more of the weight of said porous absorbent, and natural wood pulp fiber the remaining amount.

31. A porous absorbent according to claim 20, wherein said porous absorbent contains virgin cellulose of 30 to 50%, old paper fiber of waste newspaper of 25 to 35%, and waste hemp fiber of 25 to 35%.

32. A porous absorbent according to claim 20, wherein said porous absorbent contains waste natural fiber having a numerical average of fiber length of 50 mm or less.

33. A porous absorbent according to claim 20, wherein the thickness of said porous absorbent is 1 mm or more.

34. An ink jet recording apparatus for recording on a recording medium by use of a recording head capable of discharging ink, comprising:

a porous absorbent according to any one of claims 20 and 21–33 as an absorbent for waste ink exhausted from said ink jet recording apparatus.

35. An ink jet recording apparatus according to claim 34, wherein said waste ink contains at least one of ink suctioned and exhausted from ink discharge ports of said recording head, ink exhausted from the ink discharge ports of said recording head under pressure, and ink discharged from said recording head but not contributing to image recording.

36. An ink jet recording apparatus according to claim 34, wherein said recording head is provided with electrothermal converting elements for generating thermal energy for discharging ink.

* * * * *

UNITED STATES PATENT AND TRADEMARK OFFICE

CERTIFICATE OF CORRECTION

PATENT NO. : 6,858,273 B2
DATED : February 22, 2005
INVENTOR(S) : Kawano et al.

It is certified that error appears in the above-identified patent and that said Letters Patent is hereby corrected as shown below:

Column 4,
Line 52, “(Structural” should begin a new heading.

Column 6,
Line 9, “(First” should begin a new heading.
Line 53, “mHg” should read -- mmHg --.

Column 7,
Line 13, “Wayerhaeuser” should read -- Weyerhaeuser --.

Column 8,
Line 11, “therefore” should read -- therefor --.

Column 13,
Line 14, “rest” should read -- test --.
Line 54, “is the” should read -- in the --.

Column 15,
Line 65, “Further,” should begin a new paragraph.

Column 18,
Line 34, “claims 1-13,” should read -- claims 1-16 --.
Line 35, “14, 15 and 16” should be deleted.
Line 36, “inkjet” should read -- ink jet --.

UNITED STATES PATENT AND TRADEMARK OFFICE

CERTIFICATE OF CORRECTION

PATENT NO. : 6,858,273 B2
DATED : February 22, 2005
INVENTOR(S) : Kawano et al.

It is certified that error appears in the above-identified patent and that said Letters Patent is hereby corrected as shown below:

Column 20,
Line 14, "20 and" should read -- 20-33 --.
Line 15, "21-33" should be deleted.

Signed and Sealed this

Twenty-first Day of March, 2006

JON W. DUDAS
*Director of the United States Patent and Trademark Office*